United States Patent [19]

Durand

[11] 4,323,021

[45] Apr. 6, 1982

[54] PLEATING AND SMOCKING MACHINE

[76] Inventor: Dianne R. Durand, 6709 Glen Brook Dr., Knoxville, Tenn. 37919

[21] Appl. No.: 247,096

[22] Filed: Mar. 24, 1981

[51] Int. Cl.[3] ..... D05B 35/08; D05B 1/04

[52] U.S. Cl. ..... 112/133; 112/174; 223/32

[58] Field of Search ..... 112/133, 132, 134, 174; 223/32

[56] References Cited

U.S. PATENT DOCUMENTS

| | | | |
|---|---|---|---|
| 2,232,178 | 2/1941 | Keet | 223/32 |
| 2,277,366 | 3/1942 | Naftali | 112/174 |
| 2,303,380 | 12/1942 | Naftali et al. | 112/174 |
| 2,551,808 | 5/1951 | Minns | 223/32 |
| 2,583,582 | 1/1952 | Malek et al. | 112/174 |
| 3,770,543 | 11/1973 | Darabant | 112/132 X |

*Primary Examiner*—H. Hampton Hunter

*Attorney, Agent, or Firm*—Scrivener, Clarke, Scrivener and Johnson

[57] ABSTRACT

The disclosure relates broadly to sewing machines and provides a machine for pleating a fabric or other sheet material by passing it between intermeshed toothed rollers which produce pleats and deliver the material onto needles which are supported by the rollers.

5 Claims, 4 Drawing Figures

PLEATING AND SMOCKING MACHINE

SUMMARY OF THE INVENTION

A machine for pleating or smocking a fabric or other sheet material by passing it between elongated intermeshed toothed rollers onto needles which are supported by the rollers has incorporated into it means for preventing flexing of the rollers at the delivery side of the machine, thereby increasing the width of material that can be processed. Bobbins are provided on the machine for holding the thread for each needle, and means are provided for tensioning the thread passed from each bobbin to a needle.

DESCRIPTION OF THE INVENTION

Figure 1:
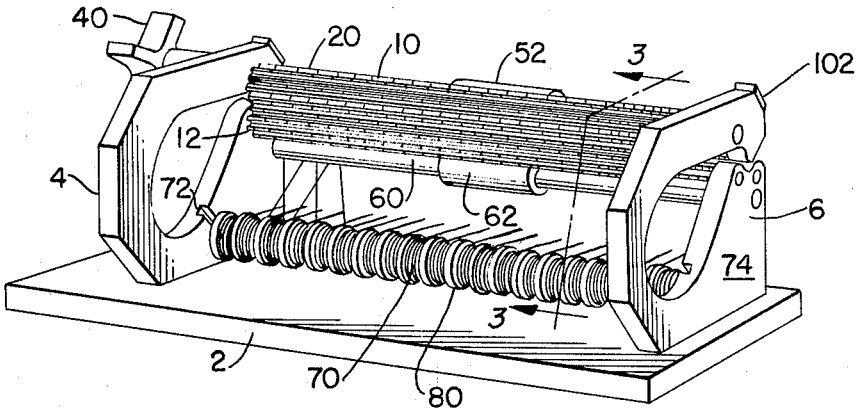
FIG. 1 is a perspective view of the front of the machine showing the first set of rollers encountered by the material.
Figure 2:
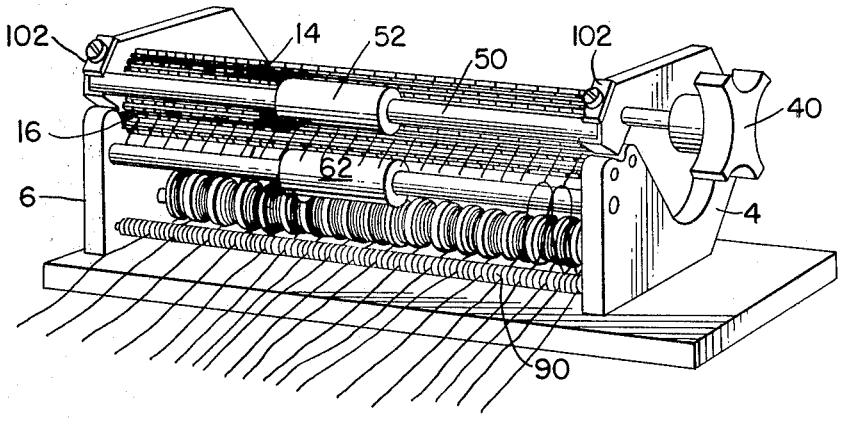
FIG. 2 is a perspective view of the rear of the machine showing the second set of rollers, the bobbins and means for tensioning the thread passing from each bobbin.

A pleating or smocking machine incorporating the improved means provided by the invention is disclosed in the drawings and comprises a base 2 which supports two spaced parallel vertical end members 4,6. The end members, which are of improved, novel and useful structure which will be described, provide journal bearings for the ends of the shafts of a first pair of toothed rollers 10, 12 and a second pair of toothed rollers 14, 16. The axes of the four rollers are parallel, and the rollers 10, 12 of the first pair are positioned at the input side of the machine, and therefore first receive the material fed to the machine while the rollers of the second pair are positioned on the delivery side of the first pair.

The rollers of the first pair are so positioned that roller 10 is above roller 12 with the teeth of the two rollers intermeshed, while the rollers of the second pair are so positioned that roller 14 is above roller 16 with their teeth intermeshed, and the teeth of upper roller 14 of the second pair are also intermeshed with those of lower roller 12 of the first pair. The intermeshing of the rollers of each pair and of the rollers 12, 14 is sufficiently loose to permit the material being pleated to pass easily between the intermeshed teeth of the rollers.

Each roller is preferably of unitary construction from end to end, and the teeth of each roller are provided at spaced points along its length with a circumferential groove, each groove of each roller lying in the same plane transverse of the axes of the rollers as corresponding grooves of the other three rollers, the co-planar grooves being referred to as a set of grooves and being indicated at 20, 22, 24, 26 in the rollers 10, 12, 14, 16 respectively.

Figure 3:
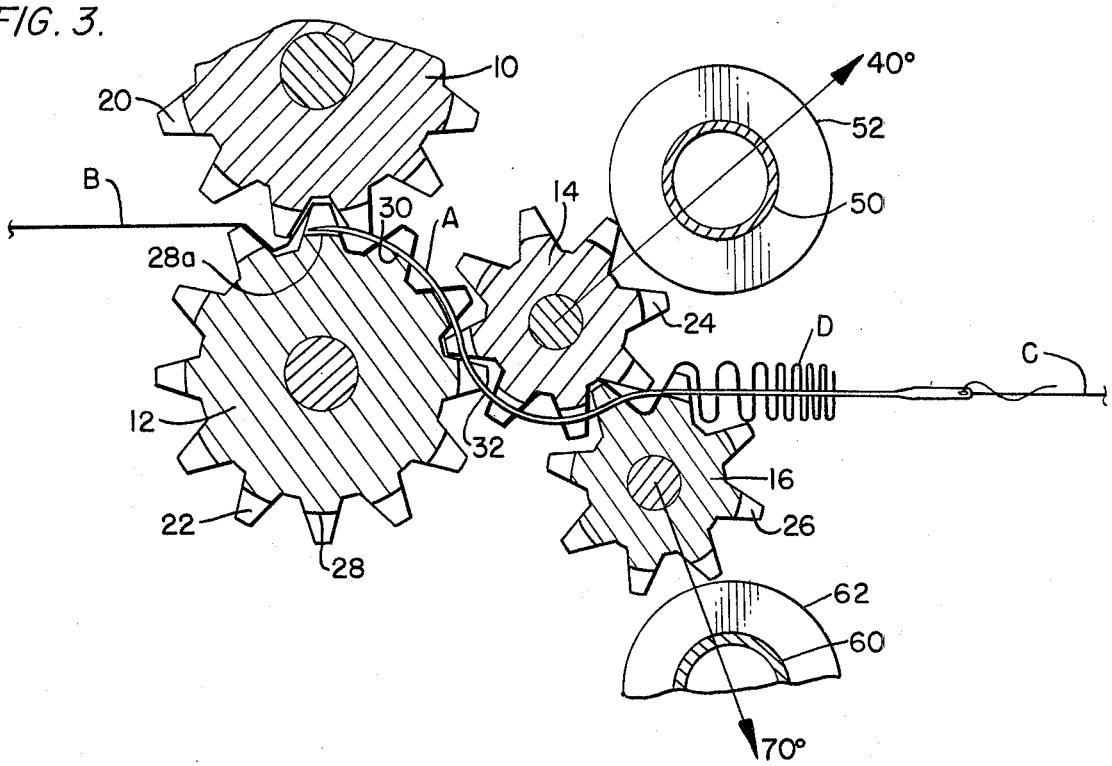
FIG. 3 is a sectional view taken on line 3—3 of FIG. 1.
Figure 4:
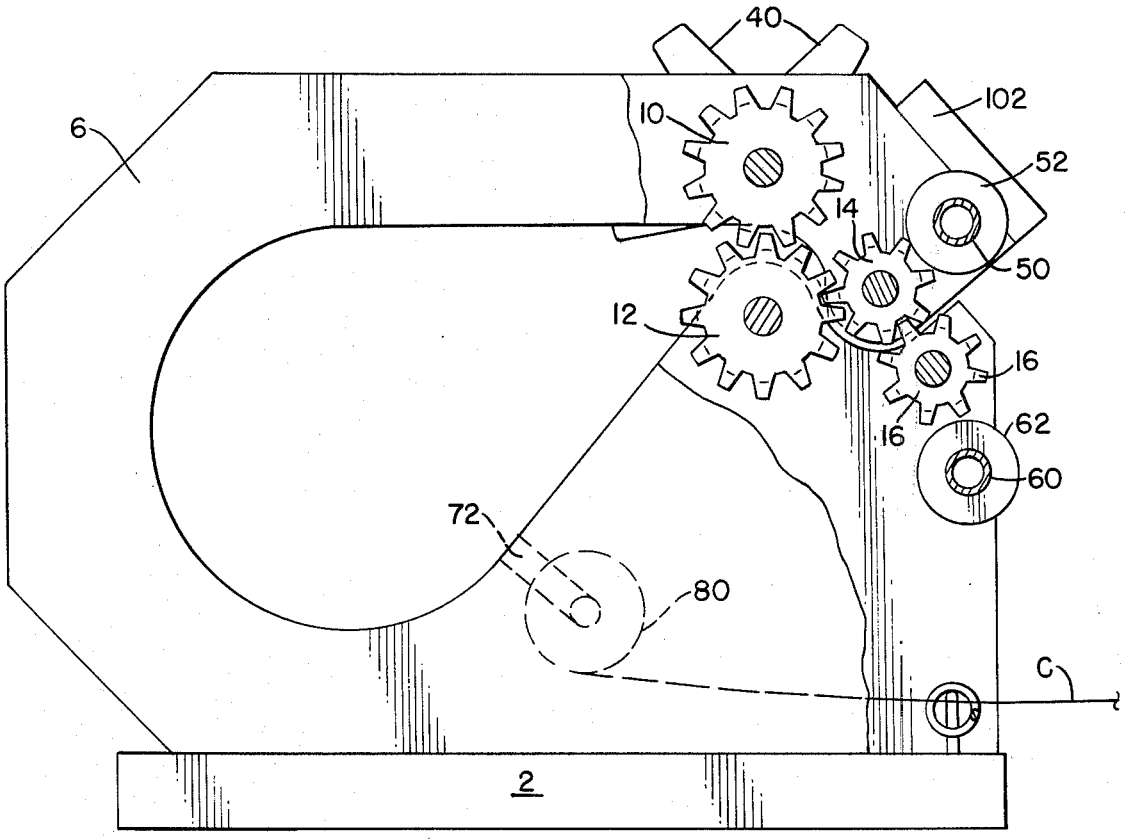
FIG. 4 is an end view of the machine.

The bottoms 28 of the grooves of each set of grooves lie on a generally S-shaped cfurve and thus provide a supporting base for a generally S-shaped needle A having its pointed end adjacent the point of entry of the sheet material B between the rollers of the first pair, as particularly shown in FIG. 3, and having its eye end positioned on the delivery side of the second pair of rollers 14, 16. The eye of each needle receives a length of thread C on which the pleated or gathered part D of the fabric is received. When so positioned the concaved lower surface 30 at the leading end part of the needle rests on the upwardly facing convex upper surfaces 28*a* of the bottoms of the groove in roller 12, and the downwardly and rearwardly facing surface 32 at the trailing end of the needle rests on the forwardly facing bottom surfaces of the grooves of roller 14.

In the operation of the machine, each needle is subjected to the force of gravity and the force exerted by the moving rollers and material urging the needle toward the delivery end of the machine. The force of gravity is balanced by interaction between the groove bottom surfaces of roller 12 and the correspondingly shaped surfaces of the needles which rest on these groove surfaces. The lateral force on each needle is balanced by interaction between the groove bottom surfaces of roller 14 and the correspondingly shaped surface 32 of each needle, which engage the groove surfaces of roller 14.

The operation of pleating the material consists in offering its leading end to the throat of the roller pair 10, 12 and rotating the rollers to draw the material between the pair. The material envelopes the profile of a tooth of the roller 10 and as rotation continues the material is formed to the profile of the roller 10, as shown in FIG. 3, by being pressed into contact with the roller profile by the teeth of the roller 12, a series of pleats being thus formed in the material. As the pleats are formed they are impaled on the points of the needles, and as the material is progressively passed through the roller pair 10,12 the pleats in succession pass along the S-bend of the needle while still enveloping the teeth of the roller 10. As described, the roller 14 is engaged with the roller 12, and as the pleats move along the needles they pass in succession between the engaging teeth of these rollers and the reverse pleats formed between two original pleats became transferred on to the teeth of the roller 14 where they are retained by the bending of the needles in the direction away from the roller 12 and between the roller pair 14, 16. Continued rotation passes the pleats between the roller pair 14, 16 on to the straight trailing end part of each needle, and the pleats are finally discharged by passing off the trailing ends of the needles and on to the threads C.

The result of the described construction is that each needle is maintained in a floating condition between the rollers, so that the material B can pass relatively over the needles from points to trailing ends and on to the threads C while each needle is constrained against bodily movement relatively to the rollers both vertically and in the direction of the length of the needle, and is stabilised in the plane in which it is curved.

The roller 10 is arranged to be driven by means such as a crank handle 40 connected to the shaft of roller 10, and the drive is transmitted to the other rollers of both pairs by reason of the fact that the teeth of the rollers are intermeshed.

In the operation of a machine of the described type and construction the pleating or smocking of the material and its passage along the needles produces forces of considerable magnitude on the rollers in the direction of the delivery end of the machine, which is the direction of the arrows shown in FIG. 3, and it will be seen that the force on roller 14 is directed at an angle of approximately 40° above the horizontal and that the force exerted on roller 16 is exerted at an angle of approximately 70° below the horizontal, both in the direction of movement of the pleated material from the machine. These forces have limited the possible number of needles in existing machines, as the forces cause flexing of the rollers 14, 16 in the directions described. Such flexing adversely affects the operation of the machine and limits the number of needles which may be used to about 16 needles for a total dimension of about 6 inches of length of the rollers. This has, of course, imposed a severe restriction on the utility of machines of this type.

Means are provided by the invention which permit a major increase in the number of needles which may be incorporated in a machine, thereby increasing the range of its utility by increasing the width of fabric which may be processed. The preferred means, as shown in the drawings, comprise, first, a rod 50 extending between and supported by the end members 4, 6 adjacent the roller 14 and disposed with respect to that roller in such a way that the axes of the roller 14 and rod 50 lie on the line positioned approximately 40° above the horizontal as shown in FIG. 3. A sleeve 52 preferably formed of a synthetic plastic material such as polyethylene is mounted on this rod adjacent the mid-point of the roller 14 with its periphery in engagement with the outer surface of the roller. A second rod 60 extends between and is supported by the end members and is positioned so that its axis and the axis of roller 16 lie on the line positioned approximately 70° below the horizontal, as shown in FIG. 3. A sleeve 62 formed of a synthetic plastic material, such as polyethelene, is mounted on this rod adjacent the midpoint of the roller with its periphery in engagement with the roller. The sleeves 52, 62 do not necessarily extend throughout the length of the rod on which they are respectively mounted, and in the preferred embodiment of the invention each is approximately 3 to 4 inches in length and positioned at the longitudinal center of the rollers 14 and 16, respectively. The rods 50 and 60 are preferably supported in the end members for rotation, thereby eliminating any friction between each sleeve and the roller on which it bears.

Means are also provided by the invention for incorporating into the machine means for storing the thread supplied to each needle, and for producing in each thread a tension which causes each thread to be guided directly from the storage means to the needle, thereby preventing any tangling between threads. Such means comprise a rod 70 which is positioned at the lower part of the machine below the pleating rollers and the ends of which are received within slots 72, 74 in the end members 4, 6 respectively, whereby the rod may be removed and replaced. A plurality of thread bobbins or spools 80 are mounted along the length of this rod and held in position by any suitable means, the number of spools being preferably equal to the number of needles on the machine, and on each spool there is wound the thread to be supplied to one of the needles, the thread on each spool being preferably directed to the needle immediately above it.

Means are provided by the invention for tensioning each thread between its storage spool and the needle to which it is supplied, and such means comprises an elongated extension spring 90 which is mounted between and supported at its ends by the end members 4, 6 in a position adjacent and preferably below the spools 80. This spring comprises closely adjacent coils, and the thread from each spool is directed and positioned between adjacent coils and then led to a needle. The coils press on each thread and thereby restrain its movement and produce on it a slight tension which insures that the thread will travel in a straight path and will not become entangled with other threads.

The rollers 10, 12, 16 and rod 60 are preferably permanently and rotatably supported in the end members. The roller 14, however, is preferably removably supported in the end members by having its two end shafts movably received within inclined slots 100 in the end members. A hold-down plate 102 is provided on each end member for maintaining each end of the roller and rod 50, in the slot, and these plates may be held in place by screws.

I claim:

1. A machine for pleating or smocking textile and like material comprising:

(a) a frame formed of a base and spaced parallel end members extending in the same direction from the base, (b) a first pair of toothed rollers rotatably supported one above the other by end members with their teeth intermeshed, (c) a second pair of toothed rollers rotatably supported one above the other by the end members with their teeth intermeshed, (d) the upper roller of the second pair being also intermeshed with the lower roller of the first pair whereby material passed between the two pairs of rollers travels in an S-shaped path and is pleated, (e) the teeth of each roller being provided at spaced intervals along their lengths with a plurality of aligned circumferential grooves, the aligned grooves of the four rollers forming a plurality of spaced sets of grooves extending throughout the length of the machine, (f) an S-shaped needle positioned in each set of grooves and supported by the rollers, each needle having a pointed end adjacent the first pair of rollers and a thread receiving eye at its other end adjacent the second pair of rollers, (g) and means forming part of the machine for preventing flexing of the rollers in the direction of the eye ends of the needles.

2. A machine according to claim 1, in which the means for preventing flexing of the rollers comprise two rods rotatably mounted in the end members and positioned on the needle eye sides of the second pair of rollers, a sleeve mounted on each rod adjacent the longitudinal center thereof with its periphery in engagement with one of the second pair of rollers.

3. A machine according to claim 1, comprising in addition a rod mounted on and extending between the end members and positioned below the two pairs of rollers, a plurality of thread bobbins mounted on this rod, each bobbin being mounted adjacent one of the needles whereby thread from the bobbin may be passed to the eye of an adjacent needle.

4. A machine according to claim 3, comprising in addition means for producing tension in each thread as it passes from a bobbin to the eye of a needle.

5. A machine according to claim 4, in which the means for producing tension in each thread comprises an elongated extension spring extending between and supported by the end members in a position permitting thread passing from each bobbin to a needle to pass between adjacent coils of the spring whereby pressure will be exerted on each thread producing tension therein.

* * * * *